US010610836B2

(12) United States Patent
Boticki et al.

(10) Patent No.: US 10,610,836 B2
(45) Date of Patent: Apr. 7, 2020

(54) HIGH FLOW LIQUID DISPENSING SYSTEM AND METHOD

(71) Applicants: John Boticki, Mount Pleasant, WI (US); Jim Bournoville, Racine, WI (US); Paul Larson, Racine, WI (US); Dave Horvath, Racine, WI (US)

(72) Inventors: John Boticki, Mount Pleasant, WI (US); Jim Bournoville, Racine, WI (US); Paul Larson, Racine, WI (US); Dave Horvath, Racine, WI (US)

( * ) Notice: Subject to any disclaimer, the term of this patent is extended or adjusted under 35 U.S.C. 154(b) by 399 days.

(21) Appl. No.: 14/527,725

(22) Filed: Oct. 29, 2014

(65) Prior Publication Data

US 2015/0157992 A1 Jun. 11, 2015

Related U.S. Application Data

(60) Provisional application No. 61/898,914, filed on Nov. 1, 2013.

(51) Int. Cl.
*B01F 5/04* (2006.01)
*B01F 3/08* (2006.01)

(52) U.S. Cl.
CPC ..... *B01F 3/0865* (2013.01); *B01F 5/043* (2013.01); *B01F 5/0421* (2013.01); *Y10T 137/0447* (2015.04); *Y10T 137/87587* (2015.04)

(58) Field of Classification Search
CPC ..... B01F 3/0865; B01F 5/0421; B01F 5/043; Y10T 137/0447; Y10T 137/87587
USPC ..... 137/565.22, 565.33, 565.29, 216, 888
See application file for complete search history.

(56) References Cited

U.S. PATENT DOCUMENTS

| | | | | |
|---|---|---|---|---|
| 5,159,958 | A * | 11/1992 | Sand | A47L 15/4427 137/888 |
| 5,522,419 | A * | 6/1996 | Sand | B01F 5/0413 137/216 |
| 5,738,135 | A | 4/1998 | Johnson | |
| 5,799,831 | A * | 9/1998 | Spriggs | B01F 5/0406 137/889 |
| 5,862,829 | A | 1/1999 | Sand | |
| 5,927,338 | A | 7/1999 | Boticki et al. | |
| 6,619,318 | B2 | 9/2003 | Dalhart et al. | |
| 6,634,376 | B2 * | 10/2003 | Haas | F04F 5/10 137/143 |
| 6,655,401 | B2 * | 12/2003 | Sand | B01F 5/0413 137/1 |
| 7,163,617 | B2 | 1/2007 | Treiman | |
| 7,487,795 | B2 | 2/2009 | Sand | |
| 2001/0002489 | A1 | 5/2001 | Kridl | |

(Continued)

OTHER PUBLICATIONS

Datasheet for Applicant admitted prior art. Created Jan. 9, 2007.*

(Continued)

*Primary Examiner* — Umashankar Venkatesan
(74) *Attorney, Agent, or Firm* — David A. Gottardo

(57) ABSTRACT

A high-flow liquid dispenser comprises a diluent inlet connectable to a pressurized liquid source and a backflow preventer and eductor system in fluid communication with the diluent inlet and defining a dispenser outlet for dispensing the effluent mixture. The backflow preventer and eductor system comprises at least two air gap or safe gap eductors in simultaneous fluid communication with the diluent inlet.

14 Claims, 6 Drawing Sheets

(56) References Cited

U.S. PATENT DOCUMENTS

| | | | |
|---|---|---|---|
| 2003/0034078 | A1 | 2/2003 | Haas |
| 2005/0084414 | A1 | 4/2005 | Treiman |
| 2010/0024896 | A1 | 2/2010 | Dalhart |

OTHER PUBLICATIONS

Hydrochem Model 918 Multifunction Proportioning and Dispensing Syetem (Instruction Sheet), PDF created Jan. 7, 2004, pp. 1-2.
Hydrochem Model 919 Multifunction Proportioning and Dispensing System (Instruction Sheet), PDF created Jan. 9, 2007, pp. 1-2.
Dema Model 607-3, 607-3DF & 607-3SS High Flow Fill Station Installation Instructions, Dated Dec. 1, 2009, pp. 1-3.
HydroChem Model 919 Specifications, PDF Created Nov. 19, 2015?, pp. 1-2.

* cited by examiner

HIGH FLOW LIQUID DISPENSING SYSTEM AND METHOD

CROSS REFERENCE TO RELATED APPLICATIONS

This application claims priority to U.S. Provisional Application Ser. No. 61/898,914 filed on Nov. 1, 2013.

TECHNICAL FIELD OF THE INVENTION

This invention relates generally to the dispensing of a liquid. More specifically, the invention relates to an apparatus and method for dispensing a liquid, preferably at a high flow rate and/or without any locational dependency of a dispenser upon a compliance-specific elevation location of the discharge outlet of its discharge hose, all while economically preventing any back-flow of the liquid into the liquid's inlet supply source.

BACKGROUND OF THE INVENTION

The mixing of detergent or other concentrates with a water stream commonly occurs in preparation for cleaning services within a commercial facility. During such mixing, the liquid concentrate is drawn from a source and mixed, via an eductor utilizing venturi action, with a diluent water stream to form the overall diluted detergent or other effluent mixture. The foregoing mixing function typically occurs within a wall mounted cabinet that houses one or more concentrate sources (i.e., bottles of detergent or other concentrate) and is connected to a water source. A dispensing hose is typically connected to the cabinet for dispensing the water-concentrate mixture effluent into a bucket or other receptacle.

A back-flow preventer is often utilized in dispensing systems to prevent any back-flow of the effluent mixture into the water source. A back-flow of the effluent mixture into the water source may occur if the water source incurs a reduction in pressure that falls below the static pressure existing within the output of the effluent mixture. Because it is desirable to keep water sources free from any back-flow contamination, fluid dispensers are often subjected to public regulations requiring that the dispensers utilize the foregoing back-flow preventers.

Prior art back-flow preventers for dispensing systems typically comprise a standard atmospheric vacuum breaker (AVB), or air gap or a safe gap eductors used in singularity (i.e., one-at-a-time) during dispensing operations. An atmospheric vacuum breaker, also known as a standard siphon breaker and used within the plumbing trades, is located upstream of any eductor and utilizes an air inlet valve (i.e., a float cup) that opens during any loss of fluid pressure from a liquid supply. The air inlet valve remains closed by the fluid pressure of the fluid supply. During any loss of such pressure, the air inlet valve opens the air inlet and closes the liquid supply inlet to prevent any back-flow of effluent from the eductor into the liquid supply.

Numerous disadvantages, however, are associated with using an AVB in combination with an eductor for high flow rate fluid dispensers, or any liquid dispenser for that matter. Besides being bulky and expensive, the usage of AVBs requires regular inspections, testing and certification to ensure that the device works properly and meets certain mandated functionality requirements. For example, contamination of the internal components of the vacuum breaker, as understood in the art, (e.g. mineral deposits on the float cup gasket or bonnet) may cause a loss of the seal between the float cup gasket and bonnet. Therefore, AVB manufacturers typically recommend that vacuum breakers be inspected periodically (at least monthly) for contamination and/or deterioration of the internal working components. Components should be cleaned or replaced as required.

Furthermore, the AVB, when utilized in combination with a hose-type dispenser, must be mounted at a minimum height or elevation, in relation to that of the discharge outlet of the dispensing hose, to meet various plumbing code and/or AVB manufacturer requirements. For example, the American Society of Sanitary Engineering (ASSE) Standard 1001 et seq. requires that an AVB be installed such that the AVB's critical level (CL), i.e., the extreme bottom of the AVB's body casting, is not less than 6.0 inches above the flood level rim of the fixture or appliance served. Standard 1001 et seq. of the ASSE further requires that equipment-mounted AVB's shall be installed in accordance with manufacturer's instructions and have a CL not less than 1.0 inch above the flood level of the fixture or appliance served. Furthermore, the Uniform Plumbing Code (UPC) Chapter 4 requires that potable water outlets with hose attachments be protected by an AVB installed at least 6 inches above the highest point of usage located on the discharge side of the last valve.

For dispensing systems utilizing a dispensing hose having a discharge outlet, the discharge outlet of the hose, when raised to an elevated position, thus constitutes either the "flood level" of the dispenser under the ASSE or the"highest point of usage" located on the discharge side under the UPC. Such limitations thus typically require that a dispensing system utilizing an AVB be located at a minimum height location, namely, not lower than highest point that the discharge outlet of a dispenser's dispensing hose may be raised. For example, where the discharge outlet of a dispensing hose may be raised to a height or elevation of 7 feet, the foregoing regulations would require that the AVB be located at an elevation or height of 7 feet 6 inches, i.e., 6 inches higher than that of the dispensing hose's discharge outlet. Whereas a dispenser utilizing an AVB is required to comply with such limitations relating to the location of the discharge outlet of the dispenser's dispensing hose, a dispenser utilizing an air gap or safe gap eductor need not comply with such limitations.

Thus, in seeking to avoid the use of AVB's, prior art backflow air gap and safe gap eductors have been utilized. Such eductors are used in singularity (i.e., one-at-a-time) during dispensing operations. Unlike atmospheric vacuum breakers (AVBs), air gap and safe gap eductors do not have to undergo regular inspections to ensure that they meet certain mandated functionality requirements. Furthermore, unlike AVBs. air gap and safe gap eductors do not have to be located at specific plumbing code-mandated height requirements in relation to the discharge outlet of the dispenser's dispensing hose. An air gap eductor utilizes a physical air gap separation between the liquid supply inlet and the eductor portion of the device. The separation distance (i.e., gap distance) is usually at least twice the inlet pipe diameter, but customarily not less than an inch. During fluid flow, pressurized liquid flows through the inlet, through and past the gap, and into the outlet leading to the eductor. Should the pressure of the incoming liquid supply drop while the air gap eductor is in operation, the mixed solution would be drawn backward from the eductor into the gap, with the physical air gap thereby preventing the liquid from flowing back into the supply inlet.

A safe gap eductor utilizes an elastomeric pipe interrupter between the liquid supply inlet and the eductor portion of the device. The elastomeric pipe interrupter typically comprises a rubber sleeve connected below the valve mechanism such that, when liquid is introduced into the top of the eductor, the sleeve expands against an outer tube having back-pressure escape holes defined therein. The expanded sleeve thus creates a conduit through which the liquid flows in a forward direction until a pressure reduction occurs at the liquid's inlet source. Should the pressure of the incoming liquid supply drop, the expanded sleeve collapses to expose the back-pressure escape holes of the outer tube. Any mixed solution drawn backward from the eductor thus exits into and through the escape holes of the outer tube instead of returning back into the rubber sleeve, thus preventing the liquid from flowing back into the supply inlet.

Nonetheless, certain disadvantages exist when attempting to utilize air gap or safe gap eductors in singularity in relation to high-flow-rate dispensers. For air gap eductors, such disadvantages are inherent in the geometry of the eductor itself. An air gap eductor requires that any liquid entering the eductor possess a minimal amount of force (i.e., velocity) to overcome the appreciable pressure that develops within the eductor's inlet. For closed eductors not utilizing an air gap, such a force is readily attainable through the manipulation of cross-sectional flow areas and pressures. However, because of the air gap present at the air gap eductor's inlet, pressure at the inlet will always be equal to a minimal, atmospheric pressure, thus requiring that the liquid crossing the air gap possess a substantial amount of force or velocity to enter the eductor. Because an increased force is generated through a decrease of cross sectional flow area, it may thus be difficult to achieve high volumetric flow rates through such a constricted area when the liquid source is at standard municipal service pressures of between about 30 psi and about 90 psi.

For safe gap eductors, such disadvantages are generally inherent in the construction of the eductor itself. Because the rubber sleeve of the elastomeric pipe interrupter is generally pressurized to close the back-pressure escape holes of the outer tube in ensuring that no liquid escapes while moving in a forward direction, the forward flow of liquid must undergo a reduction in cross-sectional flow area upon entering the sleeve to generate such pressure. This reduction of cross-sectional flow area thus undesirably restricts the flow rate of the eductor itself.

Furthermore, both the AVB-eductor combinations and single air gap eductor or single safe gap backflow preventers are inadequate for mixing two or more reagents with the diluent water stream to form an activated effluent mixture. For example, within the cleaning industry, chlorine dioxide (ClO2), an activated compound, is often utilized as an effective disinfectant for killing pathogenic organisms such as bacterial spores, legionella, tuberculosis, listeria, salmonella, amoebal cysts, giardia cysts, *E. coli*, and cryptosporidium. Due to its unstable nature, chlorine dioxide must be prepared immediately before use by mixing two reagents, i.e., sodium chlorite ($NaClO_2$) with hydrochloric acid (HCl), with one another in water immediately before use. Because chlorine dioxide is a gas, it must be captured in a liquid at specific concentrations to remain stable. In desiring to maintain a stability of the mixture, it is thus ill advised to mix the two reagents prior to the mixture (i.e., the gas) being captured in water. Instead, it is preferable to dilute each reagent in water and thereafter combine the reagent dilutions to create the activated mixture.

The use of an AVB-eductor combination or single air gap or single safe gap eductor having two or more concentrate inlets for mixing the foregoing sodium chlorite and hydrochloric acid reagents is ill advised because of the unstable nature of the resulting chlorine dioxide gas mixture. This is because the inlet locations for the respective reagents on the eductor, in being proximal to one another within a high velocity water stream, provide an unstable environment for adequately mixing the reagents themselves with the water such that the resulting gas is carried within the water itself. The present invention overcomes the foregoing disadvantages and present numerous other advantages over the prior art systems.

SUMMARY OF THE INVENTION

This invention relates generally to the dispensing of a liquid. More specifically, the invention relates to an apparatus and method for dispensing a liquid, preferably at a high flow rate and/or without any locational dependency of a dispenser upon a compliance-specific elevation location of the discharge outlet of its discharge hose, all while economically preventing any back-flow of the liquid into the liquid's inlet supply source. The liquid dispenser comprises a diluent inlet connectable to a pressurized liquid source and a backflow preventer and eductor system in fluid communication with the diluent inlet and defining a dispenser outlet for dispensing the effluent mixture. The eductor system defines at least one additive inlet in fluid communication with at least one respective additive source.

In one embodiment, the backflow preventer and eductor system comprises at least two air gap eductors in simultaneous fluid communication with the diluent inlet and defining respective eductor outlets. The eductors are in parallel flow relation with one another, with at least one eductor defining an additive inlet in fluid communication with an additive source. A union defining multiple inlets is in respective fluid communication with each of the eductor outlets. The union further defines a dispenser outlet for dispensing the effluent mixture, with the dispenser outlet in fluid communication with the union's inlets.

In another embodiment, the backflow preventer and eductor system comprises at least two safe gap eductors in simultaneous fluid communication with the diluent inlet and defining respective eductor outlets. The eductors are in parallel flow relation with one another, with at least one eductor defining an additive inlet in fluid communication with an additive source. The union again defines multiple inlets in respective fluid communication with each of the eductor outlets. The union further defines a dispenser outlet for dispensing the effluent mixture, with the dispenser outlet in fluid communication with the union's inlets.

DESCRIPTION OF THE EMBODIMENTS

Figure 1:
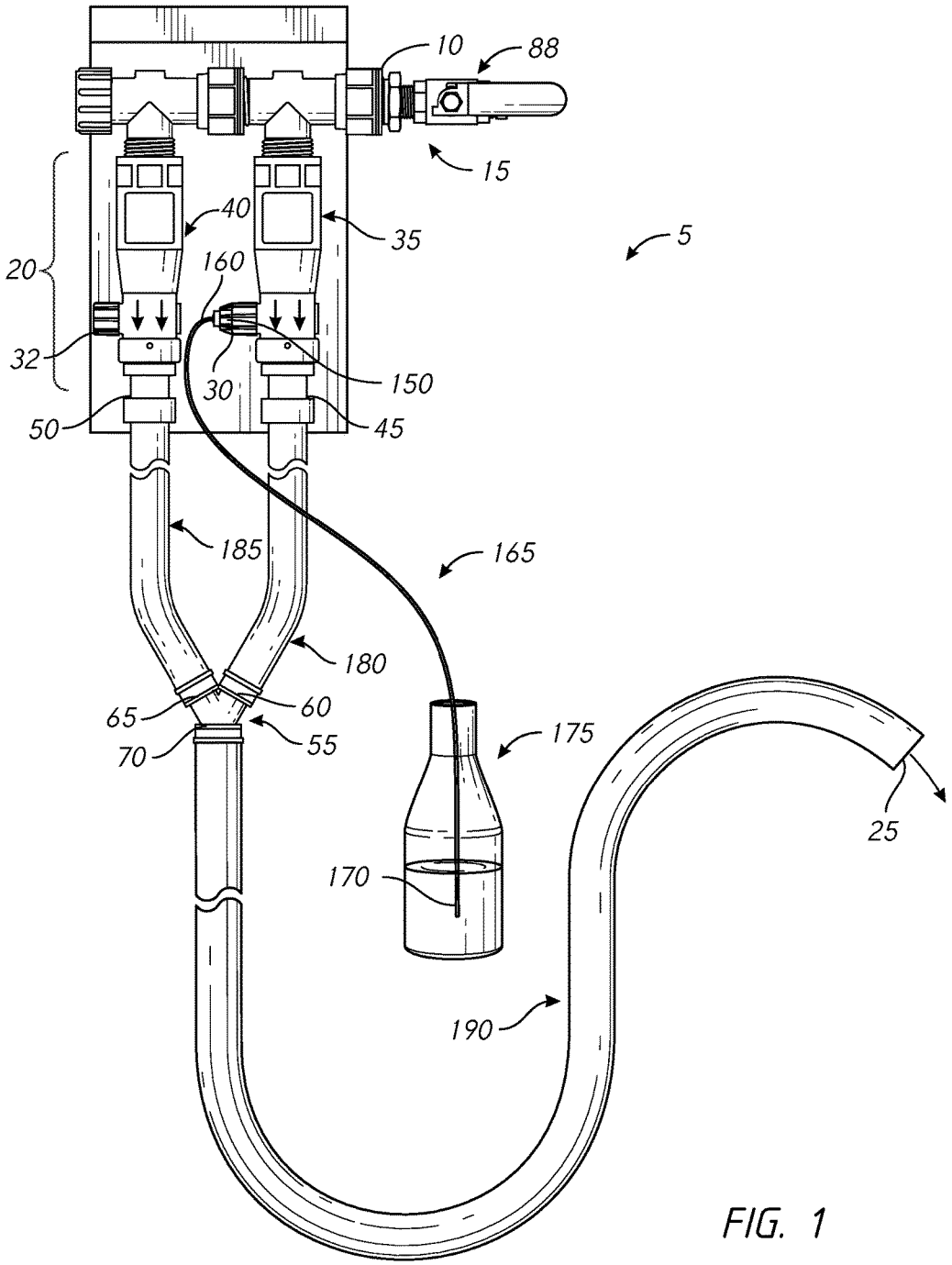
FIG. 1 is a front elevation view of one embodiment of the dispenser.

This invention relates generally to the dispensing of a liquid. More specifically, the invention relates to an apparatus and method for dispensing a liquid, preferably at a high flow rate and/or without any locational dependency of a dispenser upon a compliance-specific elevation location of the discharge outlet of its discharge hose, all while economically preventing any back-flow of the liquid into the liquid's inlet supply source. In one embodiment illustrated in FIG. 1, the liquid dispenser 5 for dispensing an effluent mixture comprises a diluent inlet 10, connectable to a pressurized liquid source 15, and a backflow preventer and eductor system 20 in fluid communication with the diluent inlet and defining a discharge outlet 25 for dispensing the effluent mixture. The system further defines at least one additive inlet 30 in fluid communication with at least one respective additive source.

In the embodiment illustrated in FIG. 1, the backflow preventer and eductor system 20 comprises at least two back-flow preventing eductors, i.e. first and second back-flow preventing eductors 35 and 40, in simultaneous fluid communication with the diluent inlet 10 and defining respective eductor outlets 45 and 50. The eductors are located downstream from the inlet and are preferably in parallel flow relation with one another. A union 55 defining at least first and second inlets 60 and 65 in respective fluid communication with each of the eductor outlets is located downstream from the eductors, with the union defining a union outlet 70 in fluid communication with the discharge outlet 25 of the dispenser 5.

Figure 2A:
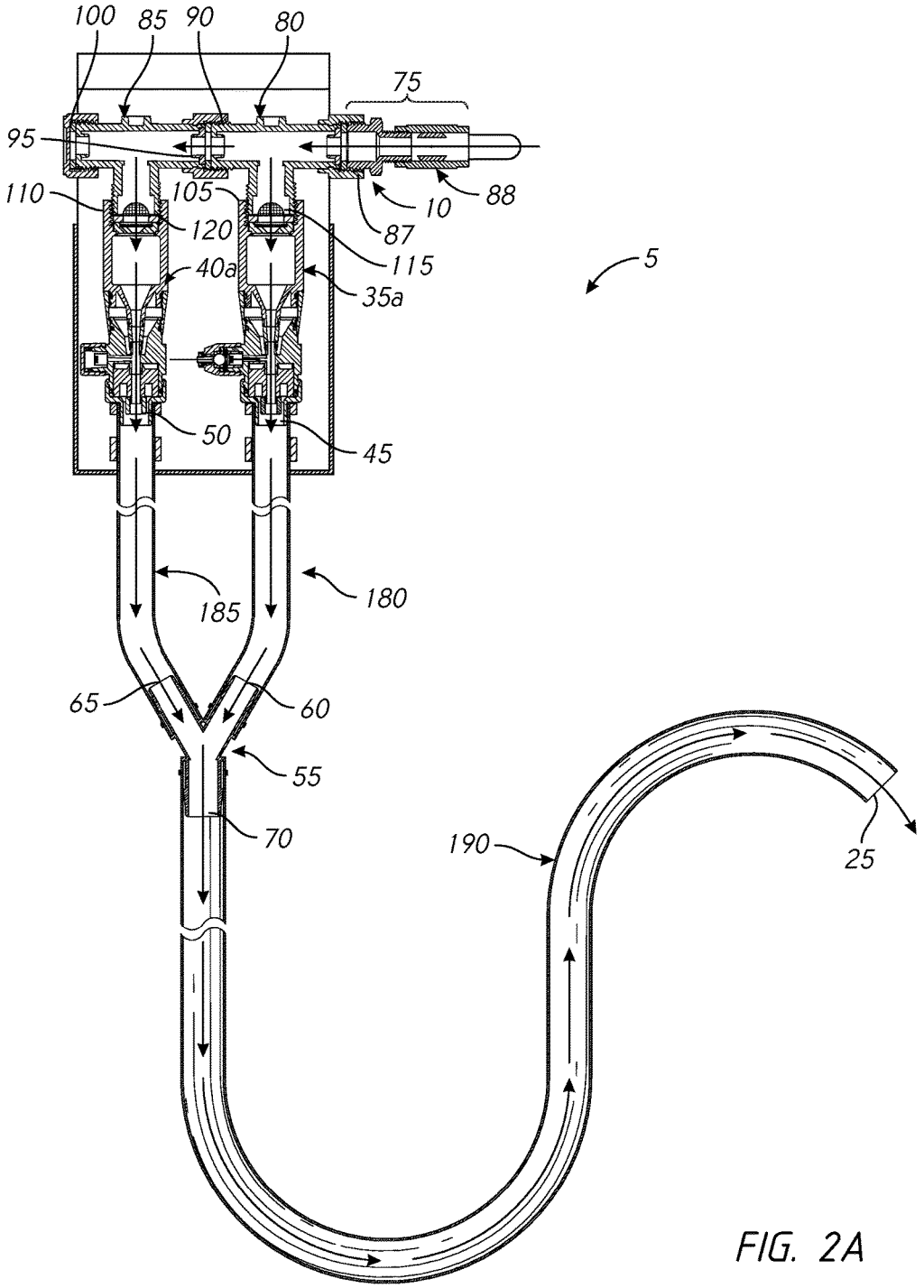
FIG. 2A is a front sectional view of one embodiment of the dispenser of FIG. 1.

FIG. 2A illustrates in section an embodiment of the high flow dispenser utilizing air gap eductors 35*a* and 40*a* for the for the back-flow preventing eductors 35 and 40. Referring to FIG. 2A, the diluent inlet 10 comprises any standard threaded connection capable of connection to any standard plumbing or piping system 75 understood in the art of conveying liquids, such as water. The piping system may comprise ¾" or ½" diameter piping and possess pressures of between about 35 psi and about 85 psi. The piping system may further possess volumetric flow rates of between about 3 gpm and about 10 gpm. In the embodiment illustrated in FIG. 2A, the first and second air gap eductors 35*a* and 40*a* of the at least two back-flow preventing eductors 35 and 40 are connected to the inlet 10 in parallel relation to one another via respective first and second piping "T connectors" 80 and 85 of at least two respective T connectors. However, any network of piping components understood in the art may connect the inlet to the air gap eductors such that all backflow preventing eductors are in simultaneous fluid communication with the inlet 10. Furthermore, while two T connectors are illustrated connecting two air gap eductors in parallel relation with one another, it is understood that 3, 4, 5 or any plurality of air gap eductors and respective T connectors may be utilized.

Referring again to FIG. 2A, first and second T connectors 80 and 85 of the at least two T connectors each define an inlet and first and second outlets. The first outlets of the respective T connectors are located coaxially with the inlets while the second outlets are located perpendicular to both the inlets and first outlets. The inlet 87 of the first T connector 80 is connected to the piping system 75 of the diluent source while the inlet 90 of the second T connector 85 is connected to the first T connector's first outlet 95. In the embodiment of FIGS. 1 and 2A, a common ball valve 88 is located between the first T connector's inlet and the diluent source such that the flow of diluent to the dispenser may be turned on and off. However, it is understood that any type of valve understood in the art of starting and stopping fluid flow may also be utilized. Furthermore, remotely or locally actuated valve systems, such as those described in U.S. patent application Ser. No. 13/921,783 and incorporated by reference herein, may be utilized as well between the first T connector's inlet and the diluent source.

As further illustrated in FIG. 2A, the first outlet 95 of the first T connector 80 is connected to the inlet 90 of the second T connector 85 while the first outlet 100 of the second T connector is capped. However, it is understood that the first outlet of the second T connector may be connected to the inlet of a third T connector (not shown), with the third T connector connected to a fourth T connector, etc for respective connection to additional air gap eductors. In keeping with the parallel flow relationship of the air gap eductors in relation to one another, the respective inlets 105 and 110 of the first and second air gap eductors 35*a* and 40*a* of the at least two eductors are connected to the respective second outlets 115 and 120 of the first and second T connectors 80 and 85.

Figure 2B:
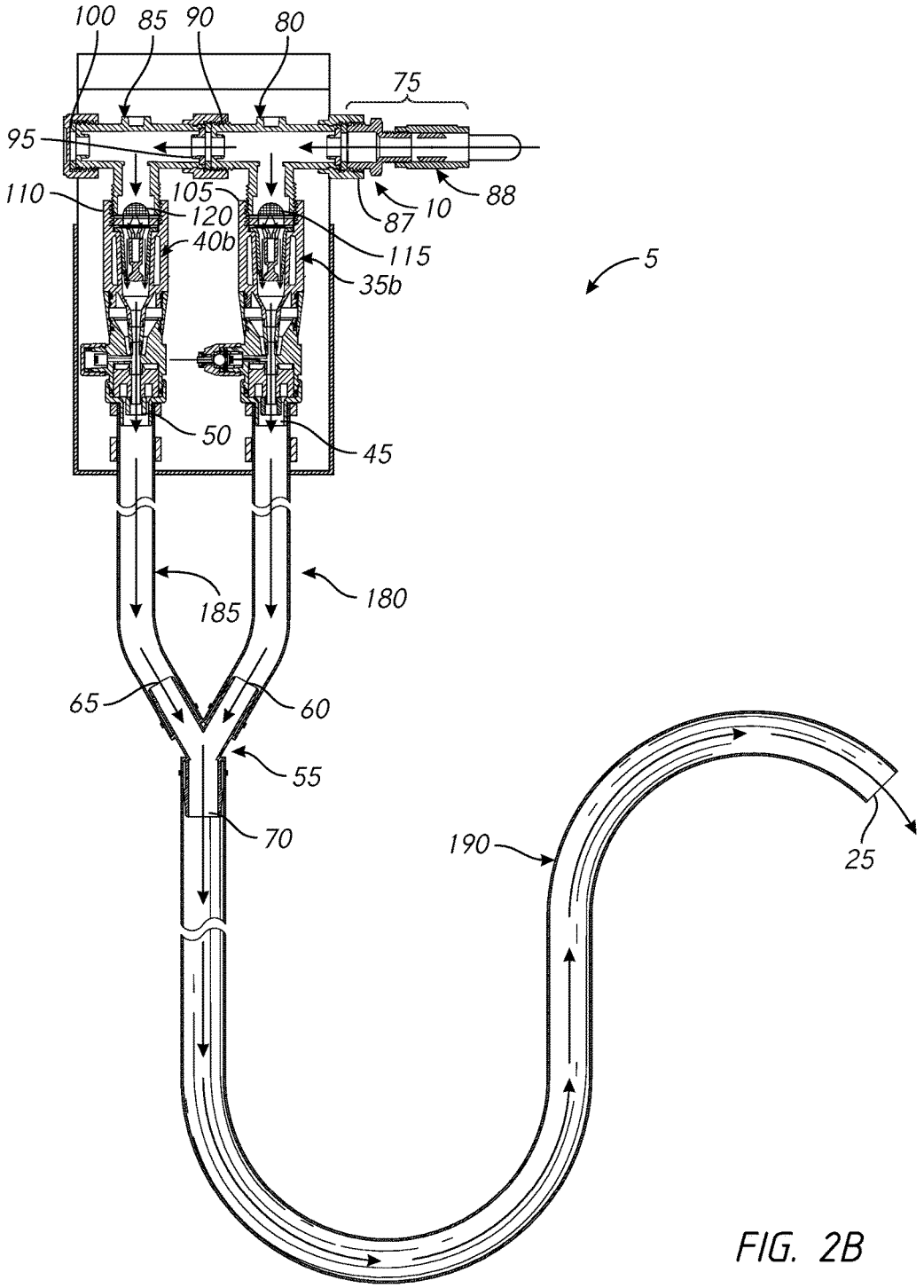
FIG. 2B is a front sectional view of another embodiment of the dispenser of FIG. 1.

FIG. 2B illustrates an embodiment of the high flow dispenser utilizing safe gap eductors 35*b* and 40*b* for the for the back-flow preventing eductors 35 and 40. Referring to FIG. 2B, the diluent inlet 10 again comprises any standard threaded connection capable of connection to any standard plumbing or piping system 75 understood in the art of conveying liquids, such as water. The piping system may again comprise ¾" or ½" diameter piping and possess pressures of between about 35 psi and about 85 psi. The piping system may further possess volumetric flow rates of between about 3 gpm and about 10 gpm. In the embodiment illustrated in FIG. 2B, the first and second safe gap eductors 35*b* and 40*b* of the at least two back-flow preventing eductors 35 and 40 are connected to the inlet 10 in parallel relation to one another via respective first and second piping "T connectors" 80 and 85 of at least two respective T connectors. Again, however, any network of piping components understood in the art may connect the inlet to the safe gap eductors such that all backflow preventing eductors are in simultaneous fluid communication with the inlet 10. Furthermore, while two T connectors are illustrated connecting two safe gap eductors in parallel relation with one another, it is understood that 3, 4, 5 or any plurality of safe gap eductors and respective T connectors may be utilized.

Referring again to FIG. 2B, first and second T connectors 80 and 85 of the at least two T connectors each define an inlet and first and second outlets. The first outlets of the respective T connectors are located coaxially with the inlets while the second outlets are located perpendicular to both the inlets and first outlets. The inlet 87 of the first T connector 80 is connected to the piping system 75 of the diluent source while the inlet 90 of the second T connector 85 is connected to the first T connector's first outlet 95. In the embodiment of FIGS. 1 and 2B, a common ball valve 88 is located between the first T connector's inlet and the diluent source such that the flow of diluent to the dispenser may be turned on and off. However, it is understood that any type of valve understood in the art of starting and stopping fluid flow may also be utilized. Furthermore, remotely or locally actuated valve systems, such as those described in U.S. patent application Ser. No. 13/921,783 and incorporated by reference herein, may be utilized as well between the first T connector's inlet and the diluent source.

As further illustrated in FIG. 2B, the first outlet 95 of the first T connector 80 is connected to the inlet 90 of the second T connector 85 while the first outlet 100 of the second T connector is capped. However, it is understood that the first outlet of the second T connector may be connected to the inlet of a third T connector (not shown), with the third T connector connected to a fourth T connector, etc for respective connection to additional safe gap eductors. In keeping with the parallel flow relationship of the safe gap eductors in relation to one another, the respective inlets 105 and 110 of the first and second safe gap eductors 35*b* and 40*b* of the at least two eductors are connected to the respective second outlets 115 and 120 of the first and second T connectors 80 and 85.

Figure 3A:
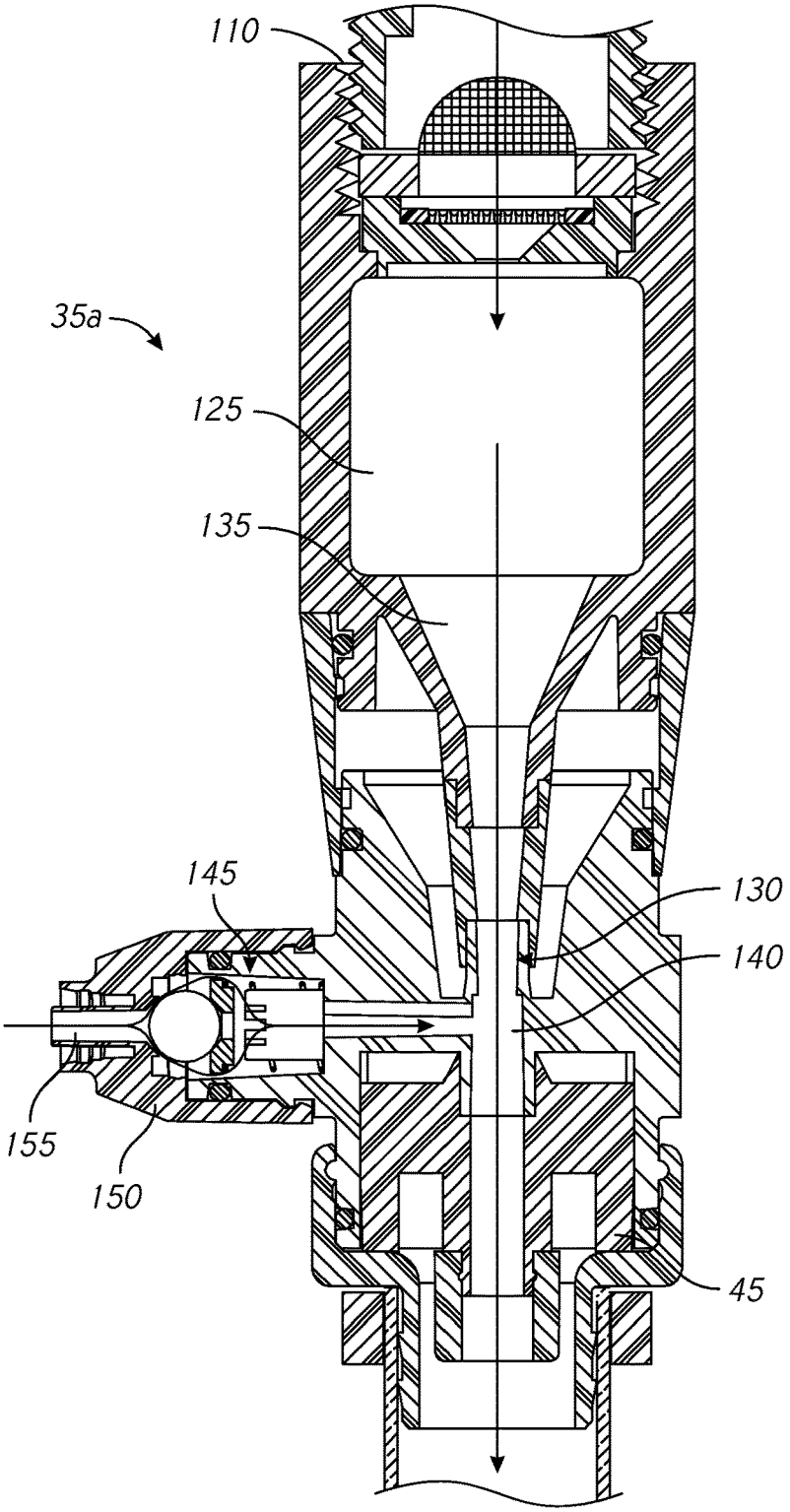
FIG. 3A is a close-up of the first air gap eductor of the sectional view of FIG. 2A.

The flow characteristics of any plurality of air gap or safe gap eductors utilized by the dispenser 5 are predetermined based upon the volumetric flow rate desired of the dispenser and the amount of additive or additives to be added to the diluent. Referring to FIG. 3A, illustrating the first air gap eductor 35*a* by example, an air gap eductor defines a physical air gap separation 125 between the air gap's inlet 110 and outlet 135. The separation distance (i.e., gap distance) is usually at least twice the inlet pipe diameter of the diluent inlet 10, but customarily not less than an inch. During fluid flow, pressurized liquid flows through the eductor inlet 110, through and past the gap 125, and into the air gap outlet 135 leading to the venturi chamber 130. Should the pressure of the incoming liquid supply drop while the air gap eductor is in operation, the mixed solution is drawn backward from the venturi chamber 130 into the gap 125, with the physical air gap thereby preventing the liquid from flowing back into the air gap eductor's inlet 110 and eventually through the diluent inlet 10 to contaminate the diluent supply source.

The inlet 110 of the air gap eductor 35*a* defines a nozzle that narrows the liquid stream to increase its velocity through the air gap 125. Such an increase in velocity is necessary for the liquid to cross the air gap and, at ambient pressure, enter the air gap outlet 135 located at the air gap's lower end. The outlet leading to the venturi chamber 130 again defines a nozzle that again narrows the liquid stream (to again increase its velocity), which is thereafter passed through a passage 140 within the venturi chamber having an increased cross-sectional area. According to the well-known Bernoulli principle, suction is created at a point where the flow channel widens within the passage 140. The result is a low pressure or vacuum point in the middle of the air gap eductor's venturi chamber 130 where at least one additive may be drawn through an additive inlet 145 of the eductor and into the liquid stream exiting the eductor's outlet 45.

The amount of additive introduced through the additive inlet 145 of the eductor is regulated by an interchangeable metering tip 150 that restrict the additive's flow into the fluid stream. The metering tip, removably attached to the eductor, controls the flow of additive into the eductor via the size if its inlet orifice 155. Should an increase or decrease of the additive flow into the eductor be desired, one may simply utilize other metering tips having larger or smaller inlets orifices to facilitate such an increased or decreased flow. However, it is understood that the metering of the additive at the eductor's additive inlet may be integral with the eductor itself, or that the metering may occur by other means understood in the art (for example, a fined metering orifice located on the supply source).

Figure 3B:
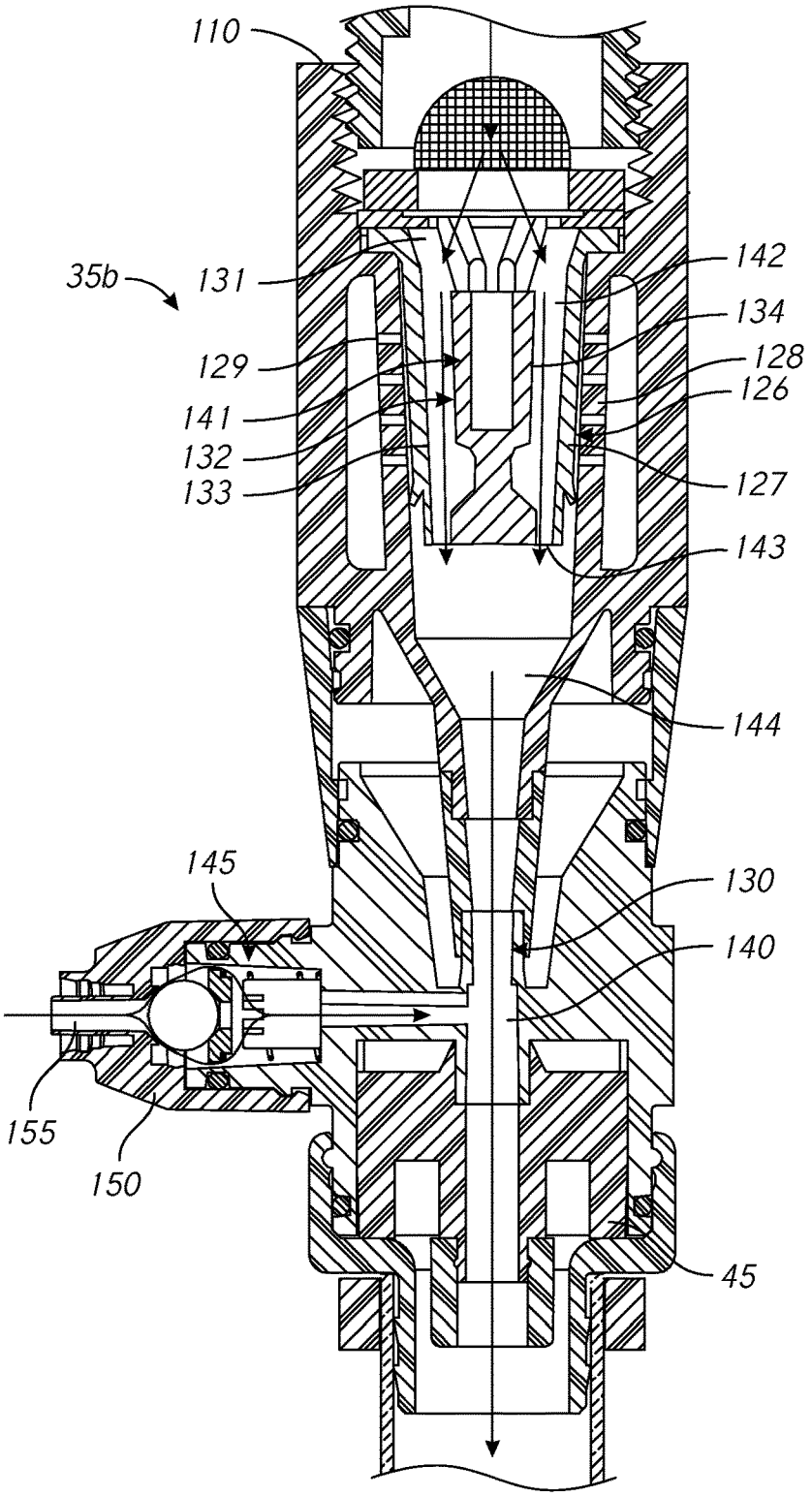
FIG. 3B is a close-up of the first safe gap eductor of the sectional view of FIG. 2B.

Referring now to FIG. 3B, illustrating the first safe gap eductor 35*b* by example, a safe gap eductor defines an elastomeric pipe interrupter 126 between the eductor's inlet 110 and venturi chamber 130. The elastomeric pipe interrupter comprises a rubber sleeve 127 that is expandable against an outer tube 128 having backpressure escape holes 129 defined therein. Should the pressure of the incoming liquid supply drop, the expanded sleeve collapses to expose the back-pressure escape holes of the outer tube. Any mixed solution drawn backward from the eductor thus exits into and through the escape holes 129 of the outer tube 128 instead of the back into the rubber sleeve 127, thereby preventing the liquid from flowing back into the safe gap eductor's inlet 110 and eventually through the diluent inlet 10 to contaminate the diluent supply source.

The inlet 110 of the safe gap eductor 35*b* defines a passageway 131 that directs the liquid stream to a chamber 132 defined between an inner wall 133 of the rubber sleeve 127 and an outer wall 134 of a central support 141 to tubular entry and exit orifices 142 and 143. The cross-sectional area of the exit orifice 143 is less than that of the entry orifice 142 to ensure that an entry of liquid into the chamber 132, via the entry orifice, facilitates the pressurization of the rubber sleeve 127. Such pressurization is necessary for the rubber sleeve 127 to block the backpressure escape holes 129 of the outer tube 128. Downstream from the exit orifice 143, an outlet 144 of the safe gap leading to the venturi chamber 130 again defines a nozzle that again narrows the liquid stream (to again increase its velocity), which is thereafter passed through a passage 140 within the venturi chamber having an increased cross-sectional area. According to the well-known Bernoulli principle, suction is created at a point where the flow channel widens within the passage 140. The result is a low pressure or vacuum point in the middle of the air gap eductor's venturi chamber 130 where at least one additive may be drawn through an additive inlet 145 of the eductor and into the liquid stream exiting the eductor's outlet 45.

The amount of additive introduced through the additive inlet 145 of the eductor is regulated by an interchangeable metering tip 150 that restrict the additive's flow into the fluid stream. The metering tip, removably attached to the eductor, controls the flow of additive into the eductor via the size if its inlet orifice 155. Should an increase or decrease of the additive flow into the eductor be desired, one may simply utilize other metering tips having larger or smaller inlets orifices to facilitate such an increased or decreased flow. However. it is understood that the metering of the additive at the eductor's additive inlet may be integral with the eductor itself, or that the metering may occur by other means understood in the art (for example, a fined metering orifice located on the supply source).

Referring again to FIG. 1, a first end 160 of a flexible additive tube 165 or lumen is connected to the metered additive inlet 150 of the back-flow preventing eductor 35. The second end 170 of the additive tube is in fluid communication with additive contained in a jug, bag, bucket or other container 175 understood in the art. Thus, the presence of a vacuum within the air gap eductor will cause the additive to be drawn from the additive container 175, through the additive tube 165 and into the eductor 40, where the additive is thereafter combined with the diluent. The diluent-additive mixture, i.e., the effluent, exits the lower end of the eductor at the eductor's outlet 45.

FIGS. 1-3A and 3B illustrate a single additive inlet 145 utilized in one of two air gap or two safe gap eductors, i.e., the first eductor 35, of the at least two eductors. However, it is understood that more than one additive inlet may be defined and utilized in a single dispenser, and that each eductor may define and utilize such an additive inlet in respective communication with each of at least two additive sources. For example, as illustrated in FIG. 1, inlet 32 of the second backflow preventing eductor 40 may be utilized to draw additive from an additional (i.e., second) bag, jug, bucket or other container (not shown). Such a configuration is desirable when combining two reagent additives with a diluent and thereafter mixing the respective combinations downstream to create a common, activated effluent for discharge from the dispenser.

Figure 4:
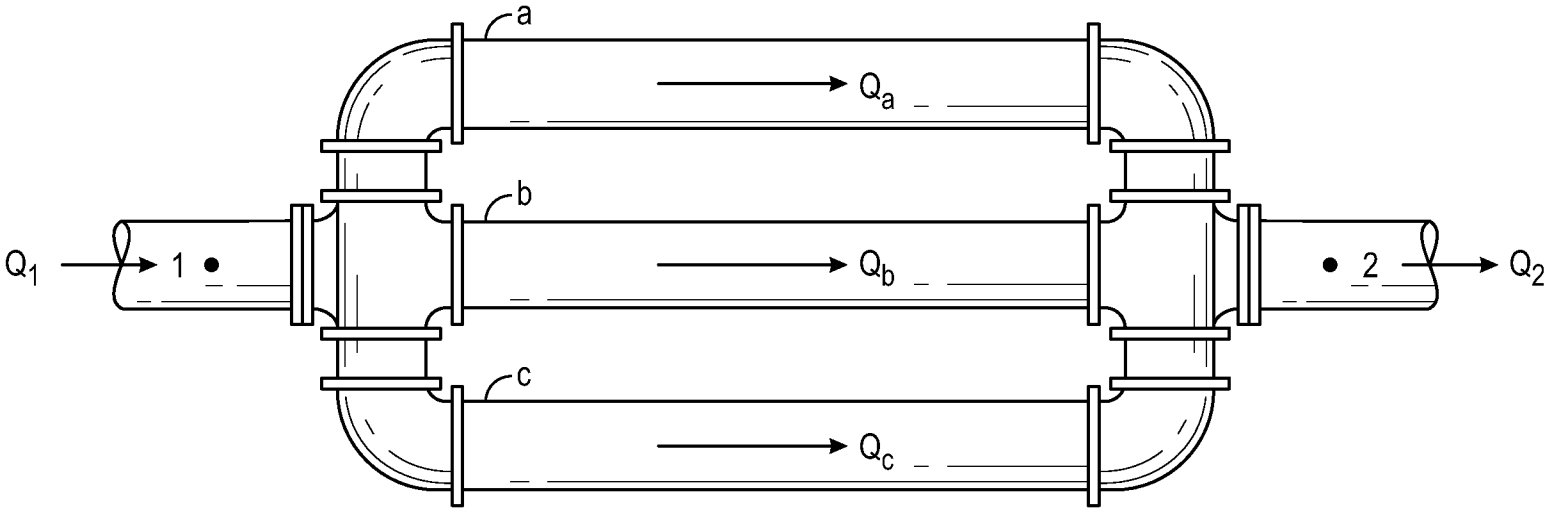
FIG. 4 is a schematic diagram illustrating principles of parallel fluid flow.

The selection of the at least two air gap or safe gap eductors is based upon the volumetric flow rate Q1 of the liquid entering the eductors and the desired volumetric flow rate Q2 of the liquid exiting the dispenser. FIG. 4 illustrates a schematic diagram of fluid flow through a parallel arrangement of pathways. Utilizing the schematic as a reference, the volumetric flow rate through the at least two air gap or safe gap eductors Qa and Qb in relation to incoming and outgoing flow rates Q1 and Q2 is as follows:

$$Q1=Q2=Qa+Qb+Qc$$

Thus, the incoming and outgoing flow rates Q1 and Q2 through the dispenser's inlet and outlet 25 are equivalent to the sum of the flow rates Qa and Qb through the air gap or safe gap eductors 35 and 40 located there-between. In one embodiment of the invention, the desired flow rates Q1 and Q2 are at least about 6 gallons per minute, preferably between about 6 gallons per minute and about 10 gallons per minute, and more preferably about 10 gallons per minute. Thus, the two air gap or safe gap eductors of the at least two eductors would each have a flow rate of at least about 3 gallons per minute, preferably between about 3 gallons per minute and about 5 gallons per minute, and more preferably about 5 gallons per minute, to achieve the overall flow of effluent from the dispenser outlet.

Referring again to FIGS. 1, 2A and 2B, the union 55 defines multiple inlets, i.e., at least first and second inlets 60 and 65 in respective fluid communication with each of the eductor outlets 45 and 50. The union further defines a union outlet 70 in fluid communication with the union's inlets. Respective connector hoses, i.e., first and second connector hoses 180 and 185, connect the multiple inlets of the union with the respective outlets of the at least two eductors while a single discharge hose 190 is in fluid communication with the union's outlet 70 to define the discharge outlet 25 of the dispenser. While the embodiments illustrated in FIGS. 1, 2A and 2B utilize two connector hoses connected between the two outlets of the respective eductors and the two inlets of the union, it is understood that additional eductors of the at least two eductors would utilize additional respective connector hoses connected between the additional outlets of these additional eductors and additional inlets of the union. Furthermore, the dispensing hose may utilize a handle or generator proximal to the discharge outlet 25, as disclosed in U.S. patent application Ser. No. 13/921,783 and incorporated by reference herein.

In use in one embodiment, at least two air gap eductors are connected to respective T connectors. The T connectors are connected to a water source while the additive inlet of at least one air gap eductor is connected to a source of additive, such as a bag, jug or other container. Water flows through the T connectors and simultaneously to the respective air gap eductors. The water is then forced through the respective inlet nozzles of the air gaps and through the air gaps to the air gap outlets. Upon entering the respective air gap outlets, the water is constricted within the respective nozzles and thereafter expanded within the respective venturi chambers of the eductors. The resulting vacuum thereafter draws additive into an additive inlet located on one or more of the eductors where the additive is mixed with the diluent and dispensed through the respective eductor's exit orifices. The respective diluent mixtures thereafter flow to the union and are combined to achieve the desired volumetric flow rate of effluent out of the discharge outlet of the dispensing hose.

In use in another embodiment, at least two safe gap eductors are connected to respective T connectors. The T connectors are connected to a water source while the additive inlet of at least one safe gap eductor is connected to a source of additive, such as a bag, jug or other container. Water flows through the T connectors and simultaneously to the respective safe gap eductors. The water is then forced through the respective inlet nozzles of the safe gaps and through the elastomeric pipe interrupters to their outlets. Upon entering the respective outlets, the water is constricted within the respective nozzles and thereafter expanded within the respective venturi chambers of the eductors. The resulting vacuum thereafter draws additive into an additive inlet located on one or more of the eductors where the additive is mixed with the diluent and dispensed through the respective eductor's exit orifices. The respective diluent mixtures thereafter flow to the union and are combined to achieve the desired volumetric flow rate of effluent out of the discharge outlet of the dispensing hose.

For dispensers dispensing an activated effluent, each of the two eductors of the at least two eductors define an inlet for introducing each of two reagent additives to the diluent flowing through each eductor. The reagents are combined with the respective diluents to create respective reagent effluents that flow from the respective eductors through respective connecting tubes to the union. The respective reagent effluents are thereafter combined at the union to create the activated effluent for discharge through the discharge outlet of the dispensing hose.

While this foregoing description and accompanying figures are illustrative of the present invention, other variations in structure and method are possible without departing from the invention's spirit and scope.

We claim:

1. A liquid dispenser for dispensing an effluent mixture comprising:

a diluent inlet connectable to a pressurized liquid source;

at least two air gap eductors in simultaneous fluid communication with the diluent inlet and defining respective eductor outlets, at least one eductor defining an additive inlet in fluid communication with an additive source; and a union defining multiple inlets in respective fluid communication with each of the eductor outlets, the union defining a dispenser outlet for dispensing the effluent mixture, the dispenser outlet in fluid communication with the union's inlets and dispensing said effluent mixture at a rate of between six gallons per minute and ten gallons per minute.

2. The liquid dispenser of claim 1 wherein the at least two eductors each define an additive inlet in respective communication with each of at least two additive sources.

3. The liquid dispenser of claim 2 wherein each additive source contains a reagent and the pressurized liquid source contains water.

4. The liquid dispenser of claim 1 wherein the volumetric flow rate of effluent through the dispenser outlet is equal to a sum of the volumetric flow rate through each of the eductor outlets.

5. The liquid dispenser of claim 1 wherein the effluent mixture is dispensed at a flow rate of ten gallons per minute.

6. The liquid dispenser of claim 1 wherein the location of the backflow preventer and eductor system is not dependent upon an elevation location of the dispenser outlet.

7. The liquid dispenser of claim 1 wherein the at least two eductors are in parallel flow relation with one another.

8. A liquid dispenser for dispensing an effluent mixture comprising:

a diluent inlet connectable to a pressurized liquid source;

at least two safe gap eductors in simultaneous fluid communication with the diluent inlet and defining respective eductor outlets, at least one eductor defining an additive inlet in fluid communication with an additive source; and a union defining multiple inlets in respective fluid communication with each of the eductor outlets, the union defining a dispenser outlet for dispensing the effluent mixture, the dispenser outlet in fluid communication with the union's inlets and dispensing said effluent mixture at a rate of between six gallons per minute and ten gallons per minute.

9. The liquid dispenser of claim 8 wherein the at least two eductors each define an additive inlet in respective communication with each of at least two additive sources.

10. The liquid dispenser of claim 9 wherein each additive source contains a reagent and the pressurized liquid source contains water.

11. The liquid dispenser of claim 8 wherein the volumetric flow rate of effluent through the dispenser outlet is equal to a sum of the volumetric flow rate through each of the eductor outlets.

12. The liquid dispenser of claim 8 wherein the effluent mixture is dispensed at a flow rate of ten gallons per minute.

13. The liquid dispenser of claim 8 wherein the location of the backflow preventer and eductor system is not dependent upon an elevation location of the dispenser outlet.

14. The liquid dispenser of claim 8 wherein the at least two eductors are in parallel flow relation with one another.

* * * * *